US009995011B1

(12) United States Patent
Gordon

(10) Patent No.: US 9,995,011 B1
(45) Date of Patent: Jun. 12, 2018

(54) PET WASTE COLLECTOR APPARATUS

(71) Applicant: Sheila T Gordon, Fairburn, GA (US)

(72) Inventor: Sheila T Gordon, Fairburn, GA (US)

( * ) Notice: Subject to any disclaimer, the term of this patent is extended or adjusted under 35 U.S.C. 154(b) by 0 days. days.

(21) Appl. No.: 15/673,452

(22) Filed: Aug. 10, 2017

Related U.S. Application Data

(63) Continuation of application No. 15/530,173, filed on Dec. 8, 2016, now Pat. No. 9,790,654.

(51) Int. Cl.

| | |
|---|---|
| ***E01H 1/12*** | (2006.01) |
| ***A47L 9/00*** | (2006.01) |
| ***A47L 5/12*** | (2006.01) |
| ***A47L 7/00*** | (2006.01) |

(52) U.S. Cl.
CPC ..... *E01H 1/1206* (2013.01); *A47L 5/12* (2013.01); *A47L 7/0061* (2013.01); *A47L 9/0018* (2013.01)

(58) Field of Classification Search
CPC ..... E01H 1/1206; E01H 1/0836; B01D 46/02; A47L 9/1427; A47L 9/0018; A47L 5/12; A47L 7/0061; A01K 23/005
See application file for complete search history.

(56) References Cited

U.S. PATENT DOCUMENTS

| | | | |
|---|---|---|---|
| 4,185,355 | A | 1/1980 | Williams |
| 5,771,531 | A | 6/1998 | Swartz |
| 6,115,879 | A | 9/2000 | Mitchell |

*Primary Examiner* — Stephen A Vu
(74) *Attorney, Agent, or Firm* — Alozie N. Etufugh

(57) ABSTRACT

An elongated and adjustable pet waste collection apparatus having an integrated vacuum or suction pump which suctions waste matter off the ground and into a pre-loaded disposable waste bag. Aspects of embodiments of the disclosure contemplate a sanitizing solution dispenser along with a heat sealer for sealing the ends of the waste bag after waste collection. The disclosure is intended to provide consumers with a simple sanitary tool for the collection and discarding of pet waste.

5 Claims, 3 Drawing Sheets

PET WASTE COLLECTOR APPARATUS

CROSS-REFERENCE TO RELATED APPLICATIONS

This Application is a Continuation application of, and claims the benefit of, and is related to, Applicant's following patent application: U.S. Non-Provisional patent application Ser. No. 15/530,173 titled "PET WASTES COLLECTOR APPARATUS", filed Dec. 8, 2016, , which has been issued as U.S. Pat. No. 9,790,654, dated Oct. 17, 2017. The Application also claims the benefit of, and is related to: U.S. Provisional Patent Application No. 62/264,536 titled "DELUXE AUTOMATIC POOP SCOOPER AKA D.A.P.S." filed Dec. 8, 2015, which is incorporated herein in its entirety

FIELD OF THE INVENTION

The present invention relates, in general, to pet waste collection, and specifically an apparatus designed for the collection and disposal of pet waste having an integrated vacuum which suctions waste matter off the ground and into a pre-loaded disposable waste bag.

BACKGROUND OF THE INVENTION

America is a country of pet lovers including, without limitation, dog lovers. According to the American Pet Products Manufacturers Association (APPMA), there are approximately 60 million owned dos in the United States. A simpler means of understanding these figures is to say that four in ten households include a family dog. Why do so many people own dogs? The answer to that question is simple; dogs provide unconditional love, companionship and unmatched loyalty to their owners. Known as "man's best friend", dogs offer protection, are faithful and are constant friends. For many owners, a favorite end to a hectic day is spent curled up on a couch or sofa with a beloved dog nestled nearby. Because dogs are more often considered a member of the family, most owners provide adequate shelter, as well as a healthy diet for their dogs.

Although a dog, or any other pet, is a delightful addition to a family, cleaning up after them can be unpleasant at best. Specifically, collecting and disposing of pet waste matter is an unsettling task. However, most conscientious dog owners realize that it is a task that must be done. In particular, those who live in cities and suburban areas are required by laws and local ordinances to remove dog or pet waste from sidewalks or lawns immediately after the pet has answered the call of nature. For those who live in less populated areas, removing pet waste is a key factor in maintaining an attractive and well-kept yard. Most people collect their pet's waste in either a plastic or paper bag. Unsanitary and disagreeable, picking up pet waste matter by hand can be a daunting and unpleasant task. Others collect the waste using a pet scooper. Although scoopers provide a hands-free means of picking up after one's pet, their handles are short and their use requires a person to stoop to the ground in order to retrieve the waste. For those with physical limitations such as back and knee problems, bending or stooping over in order to clean up after a pet can cause pain and discomfort. Further, making sure to collect all waste matter can be a challenge and unsightly residue, loaded with germs and bacteria, can nonetheless remain.

Various attempts have been made to solve problems found in vacuum operated animal waste devices. Among these are found in: U.S. Pat. No. 5,771,531 to Donna Swartz; U.S. Pat. No. 4,185,355 to Robert W. Williams; and U.S. Pat. No. 6,115,879 to Carl Mitchell. This prior art is representative of vacuum operated animal waste removers.

None of the above prior art references, taken either singly or in combination, is seen to fully address the problems of easily collecting pet waste with ease while ensuring no contact with the pet owner's hand(s). As such, there still exists a need for a portable, reliable, rechargeable device or apparatus for collecting and discarding pet waste single-handedly.

SUMMARY OF THE INVENTION

In view of the problems discussed above and the failure of the prior art to fully address these problems, the general purpose of the present invention is to provide in one aspect of an embodiment of the present invention, an elongated, rechargeable and adjustable pet waste collection device having an integrated vacuum or suction pump which suctions waste matter off the ground and into a pre-loaded disposable waste bag.

An aspect of an embodiment of the present invention contemplates a pet waste collection device which may include a cylindrical or tubular structure, where the cylindrical or tubular structure may include non-retractable and retractable portions, and a channel within the structure, a control console, connected at a first end of the cylindrical or tubular structure, where the control console may include control buttons for controlling operation of the device. In an aspect of an embodiment of the present invention, the control console may include any one or more of the following: an internal power source, a connector for receiving power from an external power source. The device may also include a suction pump located within the non-retractable portion of the cylindrical or tubular structure and in communication with the control console and the cylindrical or tubular structure's channel, a bag dispenser, located within the channel, where the bag dispenser may include at least one bag compartment for holding a waste bag, and where the at least one bag compartment may include at least one bag attachment mechanism for holding a bag in place and in line with the suction pump, and a heat sealer located at the open end of the device, where the heat sealer is aligned to seal the bag ends after collection of pet waste, where the heat sealer is in communication with the control console.

In an aspect of an embodiment of the present invention, the control console may include processor(s), where the processor(s) control operations of the device.

In an aspect of an embodiment of the present invention, the control console may include computer executable instructions executable by the at least one processor for operation of the device.

In an aspect of an embodiment of the present invention, the device may also include a sanitizer compartment, where the sanitizer compartment may include a sanitizer solution tank, a sanitizer pump in connection with the solution tank and a sanitizer dispenser nozzle leading from the sanitizer pump.

In an aspect of an embodiment of the present invention, the device may also include an access door over the bag dispenser, where the access door provides access to the bag dispenser.

In an aspect of an embodiment of the present invention, the bag attachment mechanism may include at least one pair of a hooks where each pair of hooks is configured to hold a bag in place and release the bag following waste collection.

In an aspect of an embodiment of the present invention, the computer executable instructions may include instructions executable by the at least one processor for activation of the heat sealer.

Another aspect of an embodiment of the present invention contemplates a pet waste collection device which may include a cylindrical or tubular structure, where the cylindrical or tubular structure includes non-retractable and retractable portions, a first channel and a second channel, where the second channel is parallel with the first channel and leads into the first channel within the structure, a control console, connected at a first end of the cylindrical or tubular structure, where the control console includes control buttons for controlling operation of the device, and where the control console comprises of any one or more of the following: an internal power source, a connector for receiving power from an external power source. The pet waste collection device or apparatus may also include a suction pump located within the non-retractable portion of the cylindrical or tubular structure and in communication with the control console and the channel, a bag dispenser, located within the second channel, where the bag dispenser comprises of at least one bag compartment for holding a waste bag, and where the at least one bag compartment comprises of at least one bag attachment mechanism for holding and moving a bag into the first channel in line with the suction pump, and a heat sealer located at the open end of the device, where the heat sealer is aligned to seal the bag ends after collection of pet waste, where the heat sealer is in communication with the control console.

In another aspect of an embodiment of the present invention, the device may include a motorized track located within the second channel, where the at least one attachment mechanism is attached to the motorized track and where the motorized track moves the waste bag into the first channel.

Further aspects of embodiments of the present invention may be featured, displayed, and/or represented in the accompanying drawings.

DETAILED DESCRIPTION OF THE INVENTION

Figure 1A:
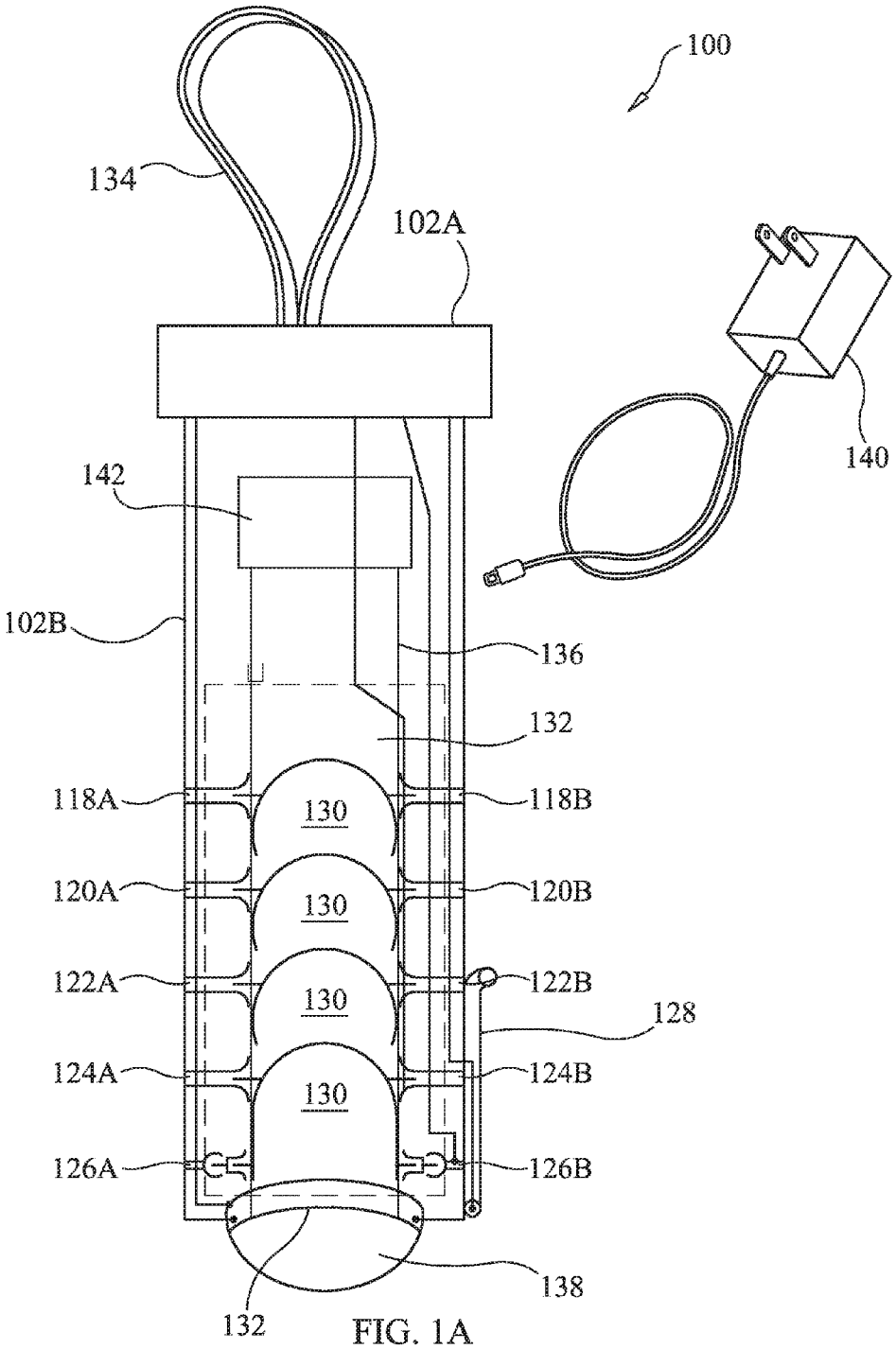
FIG. 1A illustrates a side view of a pet waste collection apparatus according to an aspect of an embodiment of the present invention.
Figure 1B:
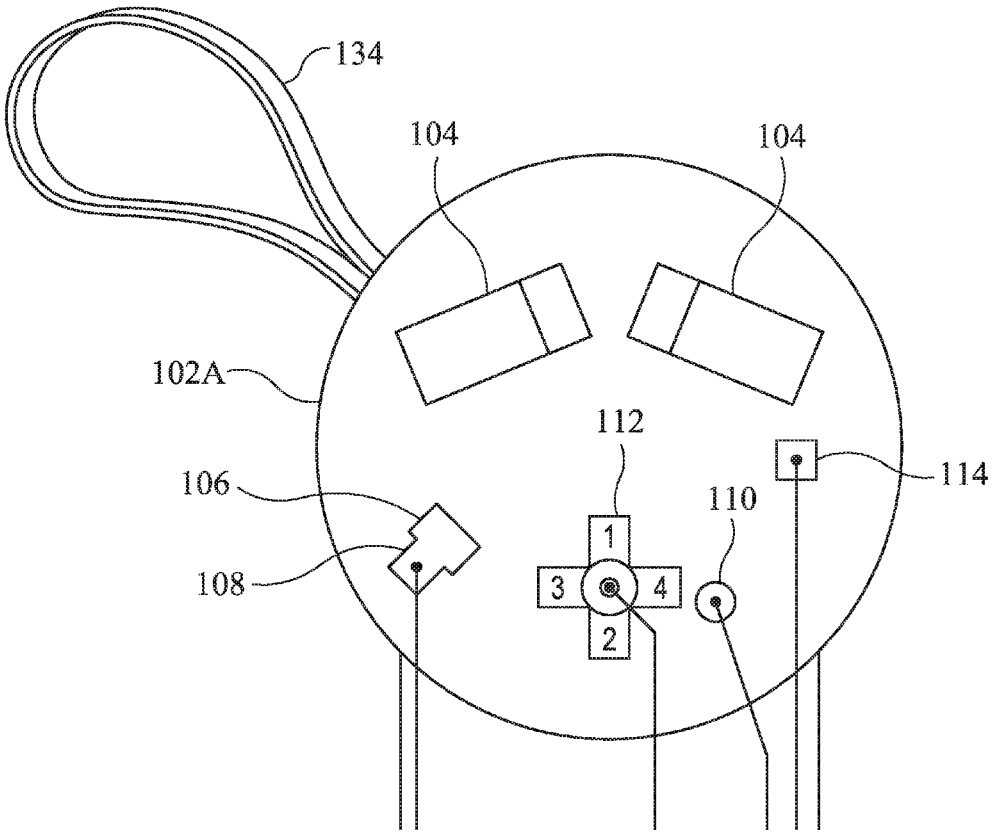
FIG. 1B illustrates a top view of a control console section of a pet waste collection apparatus according to an aspect of an embodiment of the present invention.

Referring now to FIGS. 1A and 1B, a pet waste collection apparatus 100 along with its control console 102 are shown according to aspects of embodiments of the present invention. Apparatus 100 includes a control console 102A and a cylindrical or tubular structure 102B having a nozzle for retrieving pet waste while the user is standing upright. Controls for apparatus 100 are located on or within control console 102A. Control console 102A may include power source 104, which in one aspect of an embodiment of the present invention, may be one or more batteries. In an alternate aspect of an embodiment of the present invention, power source 104 may include an adapter connection for enabling connection with an external power source such as the mains. In another aspect, power source point 104 may include a connector for receiving external power supply by way of adapter 140. Power source 104 may also include a charger port for enabling the recharging of rechargeable batteries of apparatus 100. Apparatus 100 may also include looped wristband 134, looped within a fenestration of control console 102A. Looped wristband 134 enables the user to easily transport the device hands-free.

Control console 102A may also include control/button 114 for releasing sanitizing solution, bag attachment mechanism release button 110, bag attachment mechanism selector 112, heat sealer controls or button 108 and suction/vacuum controls or button 106. Controls 106, 108, 110, 112 and 114 are all wired to, or connected with their respective elements which are discussed below. In one aspect of an embodiment of the present invention, control console 102A may include a processor and memory (not shown) connected with the operational components of apparatus 100, where the processor may be used to help in the operations of the apparatus. Control console 102B, in one aspect of an embodiment of the present invention, may be housed in a shatterproof and weather-resistant plastic material. Control console 102A is connected to cylindrical or tubular structure 102B of apparatus 100. In one aspect, control console 102B may function as a hand-grip thus enabling a user to hold and transport apparatus 100 and extend electronic wiring for connecting the controls with their respective operational components.

Cylindrical or tubular structure 102B extends from the base of control console 102A and, in one aspect of an embodiment of the present invention, includes retractable and non-retractable sections, with the non-retractable section in direct connection with control console 102A. Within the non-retractable section of cylindrical or tubular structure 102B, is suction or vacuum pump 142 which is connected with channel 136 of cylindrical or tubular structure 102B. Operation of suction pump 142 is made possible by a user depressing suction/vacuum controls or button 106 which activates suction pump 142. Channel 136 serves as the suction channel for suction pump 142 with an opening 138 at its end to allow for the suction of pet waste upon activation of suction pump 142. Further down channel 136 (away from suction pump 142) is a bag dispenser having a number of waste collection bags 130 held in place by a bag attachment mechanism. This, in one aspect of an embodiment of the present invention, may be one or more pairs of hooks 118A & 118B, 120A & 120B, 122A and 122B and 124A & 124B. Other attachment mechanisms are also contemplated. The most forward of bags 130 is positioned within channel 136 to collect pet waste suctioned by suction pump 142.

In an aspect of an embodiment of the present invention, bags 130 may be positioned within a channel parallel to channel 136. This second channel may house bags 130 and may be accessible by lid or opening 132. The second channel leads into the first channel where the bags 130 may be lined between suction pump 142 and opening 138. In this aspect, hooks 118A & 118B, 120A & 120B, 122A and 122B and 124A & 124B may be positioned within a motorized track (not shown) which moves each bag (i.e. the mouth of bag 130) into and across (to ensure capture of pet waste within it) channel 136 to collect the pet waste. The motorized track may be controlled by bag hook selector 112 which activates the motorized track to move each bag into place (i.e. into channel 136) once depressed.

At the mouth or end 138 of channel 136 is heat sealer 132 which seals the end or mouth of each bag 130 after suction is complete. Once suction is complete or after the user has released button 106, the user may then seal the ends of bag 130 by depressing button 108. In an aspect of an embodiment of the present invention, a processor in the control console 102A may detect the end of suction and may automatically activate heat sealer 132 to seal the ends of bag 130. In another aspect, heat sealer 132 may include two arms having heat sealing surfaces which come together (with the ends of bag 130 between them) to seal the ends of bag 130 once suction is complete or has been stopped by the user. In another aspect, heat sealer 132 may be activated shortly after the user has stopped suction. In another aspect, the control console 102A's processor may be programmed to time the activation of heat sealer 132, taking the suction operation and completion in consideration. For instance, the processor may be timed to activate activation of heat sealer 132 one second after the signal indicating the end of suction has been received by the processor (when the user releases button 106). In yet another aspect heat sealer 132 may begin the sealing operation while the suction is still ongoing. This may be necessary to ensure that the pet waste does not drop out of the bag once suction is complete.

The sealed bag 130, which is still held by its respective pair of hooks, may then be discarded by release of the hooks by the user depressing button 110, which activates bag stoppers 126A and 126B to release the respective hooks 118A & 118B, 120A & 120B, 122A and 122B and 124A & 124B. Bag 130 may then be discarded through opening 138 into a waste bin or other receptacle.

In an aspect of an embodiment of the present invention, apparatus 100 may include sanitizing solution dispenser 128 which includes a tank and dispensing mechanism (not shown). Following suction and discarding of pet waste, the user may then sanitize the spot by deploying sanitizing solution by way of sanitizing solution dispenser 128. Dispenser 128 may be activated by the user depressing button 114 in control console 102A.

Figure 2:
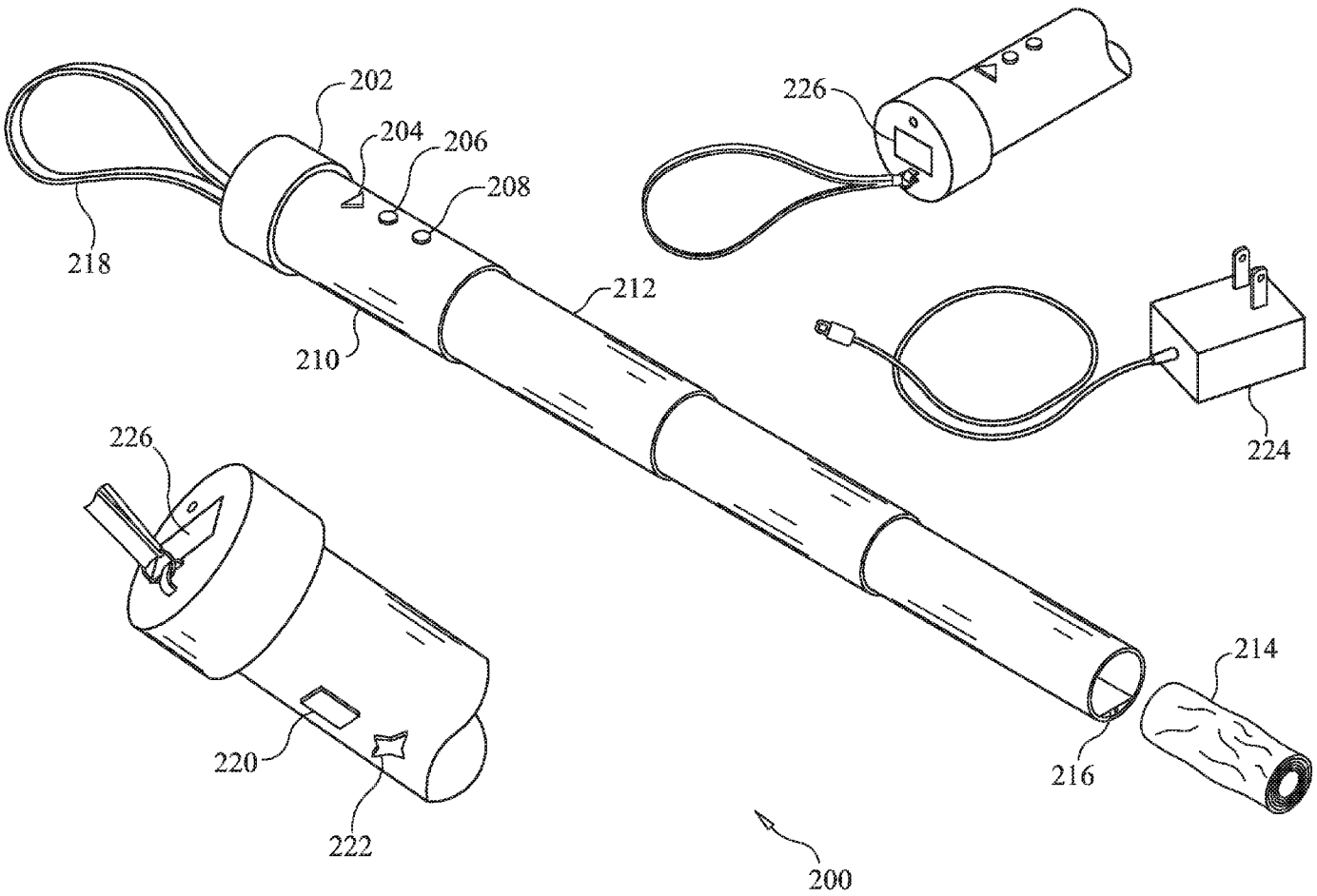
FIG. 2 illustrates a perspective view of a pet waste collection apparatus along with views of its component parts according to another aspect of an embodiment of the present invention.

Referring now to FIG. 2, a pet waste collection apparatus 200 is shown according to another aspect of an embodiment of the present invention. Apparatus 200 may, in one aspect of an embodiment of the present invention, be similar in function and control as apparatus 100 described above, sharing operational characteristics and function. Apparatus 200 is shown with top handle or hand grip 202. Positioned vertically along the front of handle 202 is non-retractable section 210 which houses the electrical or electronic components and/or operational controls for apparatus 200 including retract button 204 for retracting the retractable section 212 of apparatus 200, suction adjustment button 222 for controlling the suction force of the vacuum and on/off button 220.

Section 212, extending from the end of non-retractable section 210, houses bag release button 206, suction button 208 and suction pump (not shown) which is aligned with the retractable section 212. Section 212 is structurally configured to receive bag 214 within its channel via a nozzle at its end to enable capture of pet waste upon activation of suction pump. Bag 214 may be held in place by a number of holding mechanisms within section 212 including clips or hooks (not shown). In one aspect, the nozzle of section 212 may include a compartment inside of which bags 214 may be stored and loaded into prior to use.

Retractable section 212 may comprise of telescoping sections with these sections expanding or retracting to accommodate the user's height. A simple locking mechanism (not shown), may be used to lock the sections at the designated height. The diameter of section 212 may come in different diameters to accommodate different dog breeds.

After activation of suction pump and suction of pet waste into bag 214, bag 214 may be released by the user depressing bag release button 206. In an aspect of an embodiment of the present invention, section 212 may include a heat sealer at its end which may seal the ends of bag 214 after suction and capture of the pet waste into bag 214.

Apparatus 200 may also include sanitizing solution dispenser 216 which may be used to dispense sanitizing solution to the spot where the pet waste was suctioned from. The sanitizer solution dispensed may eradicate waste residue, kill germs & bacteria and eliminate odors.

Apparatus 200 may also include on/off button 220 for turning the apparatus on or off, and suction adjustment button 222 for adjusting the suction force or power of the suction pump. In one aspect, these may include three suction settings including light, medium and strong. These settings enable the user to modify the suction strength based on the quantity or size of waste material.

Apparatus 200 may also include battery adapter port 226 positioned on the end of the hand grip 202 for use in charging apparatus 200 using charger 224. Extending from the top of handle 202 is strap 218 which enables the user to easily transport apparatus 200.

The invention has been described in detail with particular reference to certain preferred embodiments thereof, but it will be understood that variations and modifications can be effected within the spirit and scope of the invention.

What is claimed is:

1. A pet waste collection device comprising of:
- a cylindrical or tubular structure, wherein the cylindrical or tubular structure comprises of non-retractable and retractable portions, and a channel within the structure;
- a control console, connected at a first end of the cylindrical or tubular structure, wherein the control console comprises of control buttons for controlling operation of the device, wherein the control console comprises of any one or more of the following: an internal power source, a connector for receiving power from an external power source;
- a suction pump located within the non-retractable portion of the cylindrical or tubular structure and in communication with the control console and the channel;
- a bag dispenser, located within the channel, wherein the bag dispenser comprises of at least one bag compartment for holding a waste bag, and wherein the at least one bag compartment comprises of at least one bag attachment mechanism for holding and moving a bag in place and in line with the suction pump;
- a heat sealer located at the open end of the device, wherein the heat sealer is aligned to seal the bag ends after collection of pet waste, wherein the heat sealer is in communication with the control console; and
- a sanitizer compartment, wherein the sanitizer compartment comprises of a sanitizer solution tank, a sanitizer pump in connection with the solution tank and a sanitizer dispenser nozzle leading from the sanitizer pump.

2. The device of claim 1 further comprising of an access door over the bag dispenser, wherein the access door provides access to the bag dispenser.

3. The device of claim 1, wherein the bag attachment mechanism comprises of at least one pair of a hooks wherein each pair of hooks is configured to hold a bag in place and release the bag following waste collection.

4. A pet waste collection device comprising of:
- a cylindrical or tubular structure, wherein the cylindrical or tubular structure comprises of non-retractable and retractable portions, a first channel and a second channel, wherein the second channel is parallel with the first channel and leads into the first channel within the structure;

a control console, connected at a first end of the cylindrical or tubular structure, wherein the control console comprises of control buttons for controlling operation of the device, wherein the control console comprises of any one or more of the following: an internal power source, a connector for receiving power from an external power source;

a suction pump located within the non-retractable portion of the cylindrical or tubular structure and in communication with the control console and the first channel;

a bag dispenser, located within the second channel, wherein the bag dispenser comprises of at least one bag compartment for holding a waste bag, and wherein the at least one bag compartment comprises of at least one bag attachment mechanism for holding and moving a bag into the first channel in line with the suction pump; and a heat sealer located at the open end of the device, wherein the heat sealer is aligned to seal the bag ends after collection of pet waste, wherein the heat sealer is in communication with the control console.

5. The device of claim 4, further comprising of a motorized track within the second channel, wherein the at least one attachment mechanism is attached to the motorized track and wherein the motorized track moves the waste bag into the first channel.

* * * * *